United States Patent [19]

Arakawa et al.

[11] Patent Number: 4,485,168

[45] Date of Patent: Nov. 27, 1984

[54] PHOTOCHROMIC PHOTOSENSITIVE COMPOSITION

[75] Inventors: Seiichi Arakawa, Chigasaki; Koichi Kawasumi; Junetsu Seto, both of Yokohama, all of Japan

[73] Assignee: Sony Corporation, Tokyo, Japan

[21] Appl. No.: 502,017

[22] PCT Filed: Aug. 28, 1982

[86] PCT No.: PCT/JP82/00345

§ 371 Date: Apr. 21, 1983

§ 102(e) Date: Apr. 21, 1983

[87] PCT Pub. No.: WO83/00873

PCT Pub. Date: Mar. 17, 1983

[30] Foreign Application Priority Data

Aug. 28, 1981 [JP] Japan ..... 56-135059

[51] Int. Cl.[3] ..... G03C 1/733

[52] U.S. Cl. ..... 430/345; 430/19; 430/962; 428/913

[58] Field of Search ..... 430/345, 962, 19; 106/21; 428/913

[56] References Cited

U.S. PATENT DOCUMENTS

| | | | |
|---|---|---|---|
| 4,180,405 | 12/1979 | Lawton | 106/21 X |
| 4,237,207 | 12/1980 | Ceintrey | 430/345 X |

FOREIGN PATENT DOCUMENTS

| | | | |
|---|---|---|---|
| 2252845 | 5/1973 | Fed. Rep. of Germany | 106/21 |
| 47-15122 | 8/1972 | Japan | 430/345 |
| 49-22389 | 2/1974 | Japan | 430/345 |
| 49-20389 | 2/1974 | Japan | 430/345 |
| 49-28121 | 7/1974 | Japan | 430/962 |

OTHER PUBLICATIONS

W. J. Roff (compiler), *Handbook of Common Polymers*, CRC Press, (The Chemical Rubber Company, 1971), p. 273.

A. Samat et al., "Structure Effect on the Fading Rate of Photochromic 3-Substituted Benzothiazolinic Spiropyrans", *The Journal of Physical Chemistry*, vol. 76, No. 24, 1972, pp. 3554–3558.

*Primary Examiner*—John E. Kittle
*Assistant Examiner*—Cynthia Hamilton
*Attorney, Agent, or Firm*—Hill, Van Santen, Steadman & Simpson

[57] ABSTRACT

A photochromic photosensitive composition contains a benzothiazolinospiropyran compound represented by the general formula:

wherein $R_1$ represents an alkyl group containing 1 to 10 carbon atoms, $R_2$ represents an alkyl group containing 1 to 10 carbon atoms or a phenyl group, $R_3$ represents a hydrogen atom, a halogen atom, a methoxy group or an alkyl group containing 1 to 5 carbon atoms, and $R_4$ represents a hydrogen atom, an alkyl group containing 1 to 5 carbon atoms, a methoxy group or a methylthio group, dissolved or dispersed in a bisphenol A type polyether resin for enhancing thermal stability of the compound in a colored state. Addition of a phenol to the composition serves to further enhance the heat stability. As compared with conventional photochromic compositions, this photochromic photosensitive composition is thermally extremely stable in a colored state, and the developed color image can be stored for an enough long time to be suited for long-time recording.

4 Claims, 2 Drawing Figures

PHOTOCHROMIC PHOTOSENSITIVE COMPOSITION

DESCRIPTION

1. Technical Field

This invention relates to a photochromic photosensitive composition, and more particularly to a photochromic photosensitive composition which takes on color upon exposure to ultraviolet rays and regains its initial colorless state upon application of heat or exposure to intensive visible rays.

2. Background Art

Among organic substances showing photochromism, spiropyran compounds have been investigated most intensively. When used as an actual photosensitive material, a spiropyran compound is generally dispersed in a desired binder resin and the resultant mixture is formed into a film or coated on a desired base. The photosensitive material has such properties that it takes on color upon exposure to ultraviolet rays and regains its initial colorless state upon application of heat or exposure to visible rays.

Owing to the above-described interesting characteristics of the photochromic photosensitive material which makes use of the spiropyran compound, it has been attempted to apply it to various recording or memory materials, copying materials, or the like. However, conventional photochromic photosensitive materials were difficult to use as recording materials because they were thermally unstable when colored by virtue of light and undesirably regained their initial colorless state gradually when allowed to stand, thereby limiting the storable time of developed color to 2 weeks or so at most.

When using the photochromic photosensitive material as a recording material, it is ideal that the developed color image will remain semipermanently when allowed to stand in a dark place at room temperature and it may be erased by a suitable means such as heating whenever desired. Indolinospiropyran compounds represented by the following general formula (I):

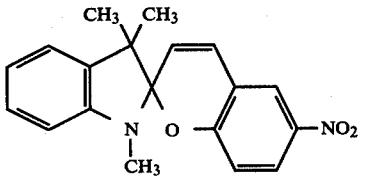

(I)

have been used predominantly among such conventionally-used spiropyran compounds. However, such indolinospiropyran compounds suffered, as mentioned above, from their insufficient thermal stability in a colored state.

DISCLOSURE OF THE INVENTION

An object of this invention is to provide a photochromic photosensitive composition which overcomes such drawbacks of the conventional photochromic photosensitive compositions, is extremely stable to heat in a colored state, is capable of storing a developed color image for an extremely long period of time and is thus suitable for long-time recording.

In the photochromic and photosensitive composition according to this invention, a spiropyran compound represented by the following general formula (II):

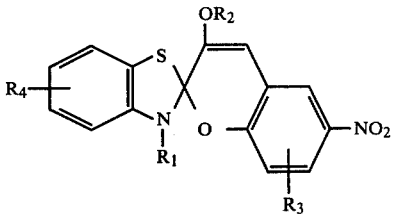

(II)

wherein $R_1$ represents an alkyl group containing 1 to 10 carbon atoms, $R_2$ represents an alkyl group containing 1 to 10 carbon atoms or a phenyl group, $R_3$ represents a hydrogen atom, a halogen atom, a methoxy group or an alkyl group containing 1 to 5 carbon atoms, and $R_4$ represents a hydrogen atom, an alkyl group containing 1 to 5 carbon atoms, a methoxy group or a methylthio group, dissolved and dispersed in a bisphenol A type polyether resin for enhancing thermal stability of the compound in a colored state.

In the above general formula (II), the alkyl group means the monovalent residue of a saturated straight chain or branched hydrocarbon, the examples of which may include methyl, ethyl, propyl, isopropyl, butyl, tert-butyl, pentyl, hexyl, octyl and decyl groups and the like. Examples of the halogen atom may include chlorine atom, bromine atom and the like.

The bisphenol A type polyether resin used in this invention is obtainable by reacting bisphenol A or its analogues with a halogenated alkylene oxide in the presence of an alkali such as sodium hydroxide. The analogues of bisphenol A may include, for example 2,2-bis(4'-oxyphenyl)propane (bisphenol A) or its derivatives. The halogenated alkylene oxide may include, for example, epichlorohydrin, 1-chloro-2-methyl-2,3-epoxypropane or the like. In addition, it is also feasible to incorporate a saturated aliphatic dicarboxylic acid such as glutaric acid, adipic acid, pimelic acid, suberic acid, azelaic acid or sebacic acid or another type of dicarboxylic acid. The epoxy groups present at both terminals may be opened. These bisphenol A type polyether resins are convenient for use as high molecular weight media since they have good compatibility with the spiropyran compound represented by the general formula (II) and also have high solubility to organic solvents which can dissolve the spriropyran compound sufficiently. A preferred example of such bisphenol A type polyether resin may be a phenoxy resin which is a high molecular compound having a recurring unit represented by the formula:

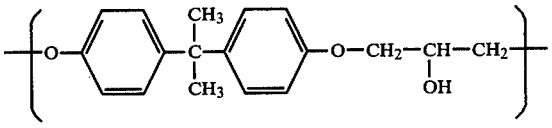

Its polarity is considered to be very high because it has one hydroxyl group per every one of its recurring units.

According to the present invention, it is also possible to incorporate a phenol additionally in the photochromic photosensitive composition. Examples of the phenol may include low molecular phenols such as bisphenol A, p-nitro-phenol, tert-butyl phenol and 1,3,5-tribromophenol; and high molecular phenols such as phenol-formaldehyde resin, creasol-formaldehyde resin, phenol resins modified by drying oil and phenol resins modified by natural resins.

The spiropyran compound in accordance with the present invention may generally be used in an amount ranging about 3 to 60 PHR (The term "PHR" means parts by weight of the spiropyran compound per 100 parts by weight of the bisphenol A type polyether resin), and more particularly about 5 to 40 PHR relative to the polyether resin. If the amount of the spiropyran compound is too small, the resultant composition will not have any sufficient coloring capacity upon exposure to light. On the other hand, any amounts of the spiropyran compound beyond the above upper limit are not preferred because the spiropyran compound may be caused to precipitate as crystals in the binder. Furthermore, it is desirous to add the phenol at a weight ratio of about 1/10 to 2 relative to the spiropyran compound, with a particularly preferred weight ratio of about 1/5 to 1. If the amount of the phenol is too small, it may be difficult to bring about, to a sufficient extent, the effects of this invention that the spiropyran compound will be stabilized against heat in its colored state. On the other hand, it is not preferred to use the phenol excessively as its effects are saturated and the coloring sensitivity of the resultant composition is lowered to a considerable extent.

The photochromic photosensitive composition according to this invention may be obtained by dissolving the spiropyran compound represented by the general formula (I) and the bisphenol A type polyether resin in a common solvent. Examples of the solvent may include a ketone such as methyl ethyl ketone and cyclohexanone, an aromatic hydrocarbon such as toluene, xylene or ethylbenzene, or an ether such as tetrahydrofuran or cellosolve acetate. These solvents may be used either singly or in combination therewith.

The solution of the composition thus prepared is then coated on a suitable base and dried. It is possible to use, as such a base, a polyester, polyimide, polycarbonate, polymethylmethacrylate, glass or metal film or sheet.

Incidentally, the thermal stability of a spiropyran compound in its colored state generally depends on the stability of the chromophore (of the mellocyanin type) of the spiropyran compound. The higher stability of the benzothiazolinospiropyran compound, which is used in the present invention, compared with that of the conventionally-employed indolinospiropyran compounds may be attributed to such an elucidation, for example, that the chromophore of the benzothiazolinospiropyran compound represented by the formula (IV):

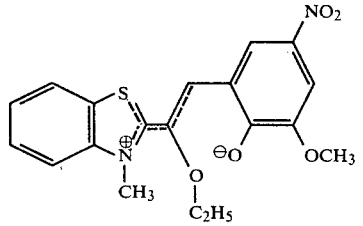

(IV)

can be stabilized owing to its resonance as S-atom contained in the compound can take a part in conjugation, contrary to the chromophore of the indolinospiropyran compound represented by the formula(III):

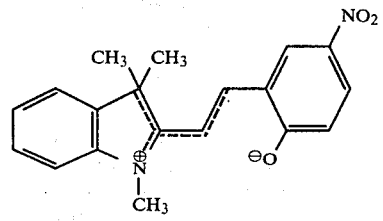

(III)

The relationship between the chromophores of spiropyran compounds and their thermal stability has been the subject of a great deal of work. It has been reported that the thermal stability of such chromophores tend to increase in a medium having a higher dielectric constant, in other words, higher polarity [for example, Flannery, J. Amer. Chem. Soc., 90, 5660 (1968)]. According to this report, it is also indicated that the thermal stability of a chromophore becomes higher as a medium, in which the chromophore is dissolved, has higher polarity and contains one or more hydroxyl groups. This report pertains to a study on the thermal stability of the chromophores in solutions using organic solvents as media.

Although the photochromic photosensitive composition according to this invention, which consists of a spriropyran compound represented by the general formula (II) and the bisphenol A type polyether resin has far higher thermal stability compared with conventional ones, its thermal stability will be enhanced further by an addition of the above-mentioned phenol thereto. In the case of a photochromic photosensitive composition consisting of the spiropyran compound represented by the structural formula (IV) and phenoxy resin for instance, 85% of its initial color density was retained after allowing the composition to stand in its colored state, for one month, at room temperature and in a dark place. It has been found that an addition of a phenol such as bisphenol A to the above composition permits it to retain 93% of the initial color density. Namely, the addition of such a phenol seems to have stabilized the chromophore represented by the structural formula (IV) owing to the donation of a hydrogen atom to the chromophore.

The photochromic photosensitive composition according to this invention obtainable as mentioned above, has extremely high thermal stability of color images and a suitable selection of the spiropyran compound and the phenol permits the retention of color images in a vivid state for a period as long as one year or more. Accordingly, the present invention has made it possible to provide photochromic photosensitive materials which are capable of storing records for long periods of time. Furthermore, erasure of produced color images can be carried out by heating them for several minutes at the temperature of about 100° C. or so or exposing them to intensive visible light. In addition, the photochromic photosensitive compositions of this invention permits repeated color development and erasure and are thus extremely useful from the practical viewpoint.

The photochromic photosensitive composition according to this invention can be used to make records by, for example, irradiating ultraviolet rays onto the photochromic photosensitive composition through a transparent original copy or mask placed thereon to obtain a negative image or, after exposing the entire surface of the composition to ultraviolet rays and causing the composition to color on its entire surface, placing a transparent original copy over the thus-colored surface of the composition and irradiating intensive visible light onto the composition through the transparent original copy to obtain a positive image. In the latter case, it is possible to make records by scanning the photosensitive composition according to this invention with a visible laser beam such as $Ar^+$ laser.

BEST MODE FOR CARRYING OUT THE INVENTION

Figure 1:
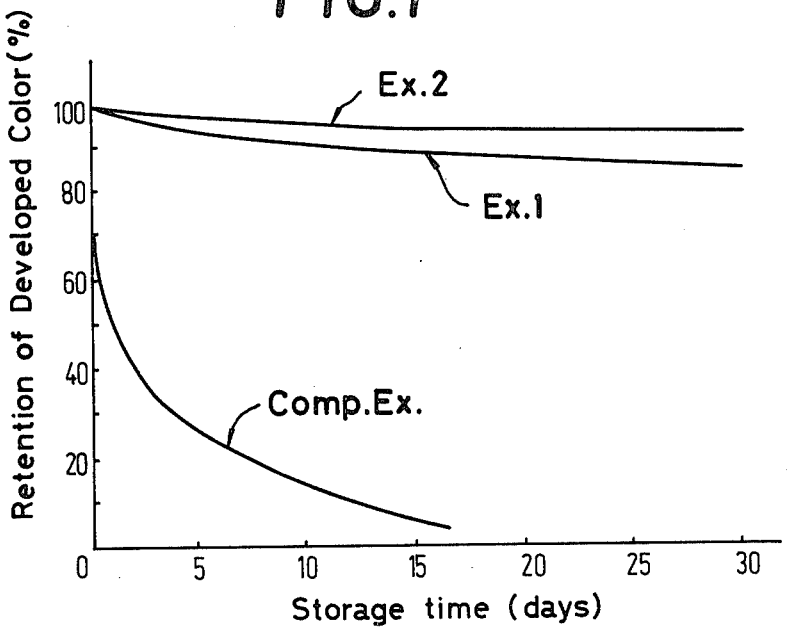
FIG. 1 is a graph illustrating the retention of the developed color in each of Examples 1 and 2 and Comparative Example 1, as a function of the number of days during which the photosensitive film was stored.

The present invention will hereinafter be described in further detail in Examples, in which each "parts" means parts by weight.

EXAMPLE 1

Synthesis of 6-nitro-8-methoxy-3-ethoxy-3'methylspiro [2H-1-benzopyran-2,2'-benzothiazoline]

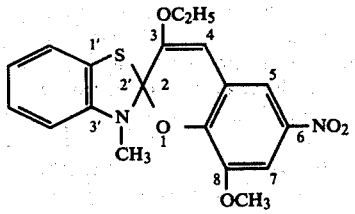

2-Aminothiophenol was reacted with an equimolar amount of ethoxyacetic acid at 110° C. for 15 hours in a sealed tube. After cooling the reaction mixture, it was neutralized with a 20% aqueous solution of sodium hydroxide, followed by an extraction with ether. Ether was driven off and the residue was then subjected to distillation under reduced pressures, thereby obtaining 2-ethoxymethylbenzothiazole (boiling point: 126°–128° C./4 mmHg; yield: 63%).

The obtained 2-ethoxymethylbenzothiazole was then added with an equimolar amount of methyl toluenesulfonate and the resultant mixture was heated at 140° C. for 30 minutes. Then, it was cooled to give 3-methyl-2-ethoxymethylbenzothiazolyl toluenesulfonate as solid (yield: 95%). It was washed with ether and then dried. The thus-dried toluenesulfonate was added with an equimolar amount of 3-methoxy-5-nitrosalicylaldehyde. The resultant mixture was dissolved with heating in ethanol. After dissolution, an equimolar amount of piperidine was added further and the resulting mixture was refluxed for 2 hours, leading to precipitation of the intended spiropyran compound. After cooling the reaction mixure, the spiropyran compound was collected and then purified by recrystallizing from a mixed solvent of benzene and petroleum benzine (melting point: 207°–208° C.; yield: 70%).

Using the thus-obtained spiropyran compound, a solution having the following composition was prepared.

| | |
|---|---|
| Spiropyran compound | 10 parts |
| Phenoxy resin ("Bakelight Phenoxy Resin PKHH"; product of Union Carbide Corp.) | 90 parts |
| 2:1 Mixed Solvent of Tetrahydrofuran and Cyclohexanone | 1,000 parts |

The solution of the above composition was coated on a polyester film and dried at 80° C. for 3 hours. The thickness of the photosensitive layer of the resultant film was 6 μm.

The film was then exposed to ultraviolet rays for 60 seconds through a ultraviolet rays-transmissive filter ("UV-D33S"; product of Toshiba Glass Co., Ltd.) using a 1-KW extra-high pressure mercury vapor lamp, thereby developing color. The color-developed film assumed bluish purple and had an absorption maximum at 575 nm. Its optical density at the wavelength was 1.8. It was allowed to stand at room temperature (25° C.) in a dark place to investigate its color fade in the dark place. Results are shown in FIG. 1. The results are expressed in terms of retention of developed color, which is defined by the following equation:

$$\text{Retention of developed color (\%)} = \frac{\text{Optical density at a given time*} - \text{Optical density before development of color}}{\text{Optical density right after development of color} - \text{Optical density before development of color}} \times 100$$

Note:
*Each optical density in the equation indicates an optical density at the wavelength giving the absorption maximum in the colored state.

In the above investigation, the color density was retained as much as 85% of the initial optical density of the developed color even upon an elapsed time of 1 month. Thereafter, a mask carring an image was closely applied on the photosensitive film and exposed to ultraviolet rays, thereby providing a negative image. This image was able to retain its sharp definition even when allowed to stand for 6 months in a dark place. On the side, the photosensitive film was in advance exposed to ultraviolet rays and caused to develope its color on the entire surface thereof. A mask similar to that used in the above test was then applied closely on the colored surface. The thus-masked surface was thereafter exposed to intentive visible light obtained by irradiating light through a yellow filter ("Y-42"; product of Toshiba Glass Co., Ltd.) from an extra-high pressure mercury vapor lamp, thereby transferring the positive image of the mask onto the photosensitive film. The developed color image showed the same thermal stability as the negative image.

COMPARATIVE EXAMPLE 1

For the sake of comparison, a photosensitive film was produced using the same composition as in Example 1 except that 6-nitro-1',3'-3'-trimethylspiro [2H-1-benzopiran-2,2'-indoline] was used. The extent of the color fading was investigated in a dark place. As illustrated in FIG. 1, the density of the developed color was reduced to less than one half of its initial color density and the color image disappeared almost completely in two weeks.

EXAMPLE 2

A photosensitive film was prepared in the same manner as in Example 1 except that bisphenol A was further incorporated in the amount of 5 parts by weight based on the spiropyran. The extent of the color fading was investigated at room temperature in a dark place. The thermal stability of the colored film was enhanced further by the incorporation of bisphenol A and, as shown in FIG. 1, 93% of the initial color density was retained even upon an elapsed time of 1 month. Furthermore, the color image on the photosensitive film was still vivid even upon an elapsed time of 1 year.

EXAMPLE 3

Using 6-nitro-3,8-dimethoxy-3'-methylspiro [2H-1-benzopyran-2,2'-benzothiazoline] (melting point: 165°–166° C.) synthesized in the same manner as in Example 1, a solution of the following composition was prepared.

| | |
|---|---|
| Spiropyran compound | 20 parts |
| Phenoxy resin (Bakelite Phenoxy Resin PKHH; product of Union Carbide Corporation) | 80 parts |
| Tert-butylphenol | 10 parts |
| 3:1 Mixed Solvent of Tetrahydrofuran and Cyclohexanone | 1,000 parts |

The solution was coated on a polyester film and then dried. The thus-produced film took on a reddish purple color upon exposure to ultraviolet rays. The absorption maximum was shown at the wavelength of 560 nm. As to the thermal stability of the film in the colored state, the retention of the developed color was 86% after stored for 1 month at room temperature in a dark place. The color image developed on the film was still vivid even upon an elapsed time of six months.

EXAMPLE 4

Using 6-nitro-8-methoxy-3-ethoxy-3'-ethylspiro [2H-1-benzopyran-2,2'-benzothiazoline] (melting point: 152°–153° C. synthesized in the same manner as in Example 1, a solution having the following composition was prepared.

| | |
|---|---|
| Spiropyran compound | 15 parts |
| Phenoxy resin ("Bakelite Phenoxy Resin PKHH"; product of Union Carbide Corporation) | 85 parts |
| Creasol-formaldehyde resin ("Sumilite Resin PR-51245"; product of Sumitomo Bakelite Co., Ltd.) | 10 parts |
| 1:1 Mixed solvent of toluene and tetrahydrofuran | 800 parts |

The solution was coated on a polyester film and then dried to produce a photosensitive film. It was then exposed to ultraviolet rays in the same manner as above, thereby taking on a reddish purple color. The absorption maximum was shown at the wavelentgh of 560 nm. The retention of the developed color in the colored state was 80% after being stored for 1 month at room temperature in a dark place. Furthermore, the color image developed on the film was still vivid even after being stored for six months at room temperature in a dark place.

EXAMPLE 5

Using 6-nitro-8-methoxy-3-phenoxy-3'-methylspiro-[2H-1-benzopiran-2,2'-benzothiazoline] (melting point: 201°–202° C.) synthesized in the same manner as in Example 1, a solution having the following composition was prepared.

| | |
|---|---|
| Spiropyran compound | 10 parts |
| Phenoxy resin ("Bakelite Phenoxy Resin PKHH"; product of Union Carbide Corp.) | 100 parts |
| 1:2 Mixed solvent of cyclohexanone and terahydrofuran | 1,000 parts |

The solution was coated on a polyester film and then dried. The thus-produced film took on a bluish purple color upon exposure to ultraviolet rays and the absorption maximum was shown at the wavelength of 590 nm. As to the thermal stability of the film in the colored state, the retention of the developed color was 78% after stored for 1 month at room temperature in a dark place. Furthermore, the color image developed on the film was still vivid even after being stored for six months at room temperature in a dark place.

COMPARATIVE EXAMPLE 2

Following the procedure of Example 1 and using a photochromic photosensitive composition containing the spiropyran compound obtained in Example 1 and vinyl chloride-vinyl acetate-vinyl alcohol copolymer ("VAGH"; product of Union Carbide Corporation), a film was prepared. Its thermal stability in a colored state was investigated. When it had been stored for 1 month at 25° C. in a dark place, the color density was reduced to 77% of the initial color density. When the storage temperature was raised to 40° C., only 65% of the initial color density was retained even 10 days later. Under the same conditions, the photosensitive film of Example 1 retained about 80% of the initial color density. In addition the spiropyran compound did not show good solubility to the vinyl chloride-vinyl acetate-vinyl alcohol copolymer.

Figure 2:
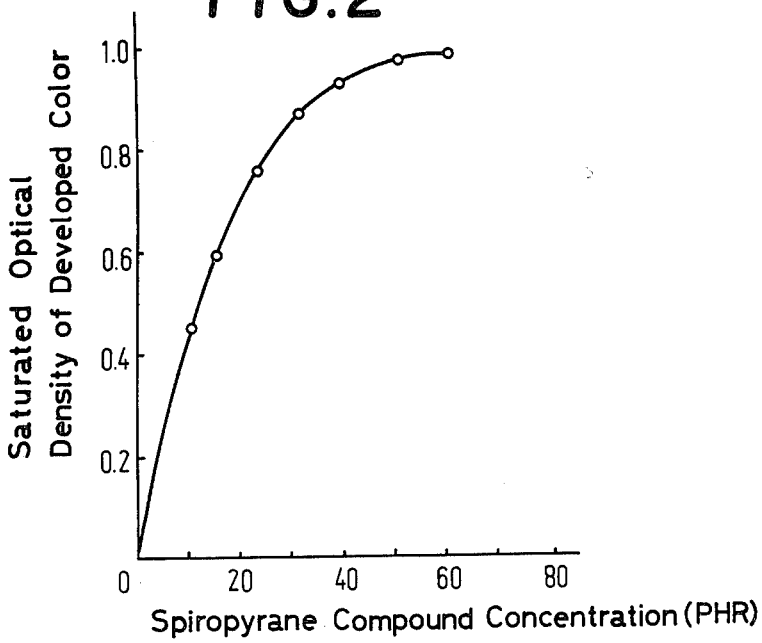
FIG. 2 is a graph illustrating the saturated optical density of the developed color as a function of the concentration of the spiropyran compound.

FIG. 2 shows results of measurement on the saturated optical density of color developed by changing the concentration of the charged phenoxy resin relative to the spiropyran compound. In this test, each photosensitive layer was 1.5 μm thick and silica glass plates were used as bases. The saturated optical density was expressed in terms of optical density at 580 nm.

As readily understood from FIG. 2, the saturated optical density of the developed color becomes higher as the concentration of the spiropyran compound increases. However, the saturated optical density shows the tendency of saturation from about 40 PHR. Beyond 60 PHR, the saturated optical density of a developed color is practically unchanged. At such high concentrations, fine crystals of the spiropyran were observed scattering throughout the photosensitive layers.

Possible Utility in the Industry

The photochromic photosensitive composition according to this invention may be used as photorecording materials such as photographing materials which use no silver salt, copying materials and CRT recording materials, as well as in the same use fields as general photochromic materials such as ornamentation and filters. It may also be used as laser-scanned recording media such as video disc. In this case, such laser-scanned recording media may be rewritable.

We claim:

1. A photosensitive composition capable of producing a colored image by exposure to ultraviolet radiation, said image being stable to heat, consisting essentially of a photochromic spiropyran compound having the following formula:

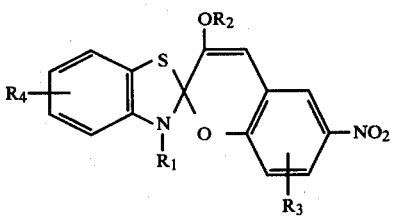

where R, represents an alkyl group containing 1 to 10 carbon atoms, $R_2$ represents an alkyl group containing 1 to 10 carbon atoms or a phenyl group, $R_3$ represents a hydrogen atom, a halogen atom, a methoxy group or an alkyl group containing 1 to 5 carbon atoms and $R_4$ represents a hydrogen atom, an alkyl group containing 1 to 5 carbon atoms, a methoxy group or a methylthio group, said spiropyran compound being dispersed in a mixture of bisphenol A type polyether resin and a phenol, said spiropyran compound being present in an amount ranging from 3 to 60 parts by weight per 100 parts by weight of said bisphenol A type resin, wherein said phenol is contained at a weight ratio of 1/10 to 2 relative to said spiropyran compound.

2. The photosensitive composition according to claim 1, wherein said spiropyran compound is contained in an amount ranging from 5 to 40 parts by weight per 100 parts by weight of said bisphenol A type polyether resin.

3. The photosensitive composition according to claim 1, wherein said phenol is contained at a weight ratio of 1/5 to 1 relative to said spiropyran compound.

4. The photosensitive composition according to claim 1, wherein said phenol is selected from the group consisting of bisphenol A, p-nitrophenol, t-butylphenol, 1,3,5-tribromophenol, phenol-formaldehyde resin, cresol-formaldehyde resin, phenol resins modified by drying oils and phenol resins modified by natural resins.

* * * * *